US009447615B2

(12) United States Patent
Muramatsu et al.

(10) Patent No.: US 9,447,615 B2
(45) Date of Patent: Sep. 20, 2016

(54) VEHICLE DOOR FIXING APPARATUS AND FASTENING MEMBER

(71) Applicant: AISIN SEIKI KABUSHIKI KAISHA, Kariya-shi (JP)

(72) Inventors: Akira Muramatsu, Chiryu (JP); Kosuke Tsukamoto, Anjo (JP); Yoshiki Odaka, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 439 days.

(21) Appl. No.: 13/965,530

(22) Filed: Aug. 13, 2013

(65) Prior Publication Data

US 2014/0070546 A1 Mar. 13, 2014

(30) Foreign Application Priority Data

Sep. 7, 2012 (JP) ..... 2012-197088

(51) Int. Cl.

| | |
|---|---|
| ***E05B 15/02*** | (2006.01) |
| ***E05B 83/36*** | (2014.01) |
| ***E05B 85/04*** | (2014.01) |
| ***E05B 15/00*** | (2006.01) |
| *E05B 63/00* | (2006.01) |

(52) U.S. Cl.

CPC ..... *E05B 83/36* (2013.01); *E05B 15/0006* (2013.01); *E05B 85/045* (2013.01); *E05B 63/0056* (2013.01); *Y10T 292/0876* (2015.04)

(58) Field of Classification Search

CPC .. E05B 83/36; E05B 85/045; E05B 15/0006; E05B 63/0056; Y10T 292/0876

See application file for complete search history.

(56) References Cited

U.S. PATENT DOCUMENTS

| | | | | |
|---|---|---|---|---|
| 3,350,128 | A * | 10/1967 | Martens | E05B 85/045 292/341.12 |
| 5,120,168 | A * | 6/1992 | Padula | F16B 31/021 411/5 |
| 2012/0112474 | A1 | 5/2012 | Muramatsu et al. | |
| 2012/0311819 | A1 | 12/2012 | Muramatsu et al. | |
| 2013/0047374 | A1 | 2/2013 | Muramatsu et al. | |

FOREIGN PATENT DOCUMENTS

| | | | |
|---|---|---|---|
| JP | 1-43298 | Y2 | 12/1989 |
| JP | 2012-097495 | A | 5/2012 |

* cited by examiner

*Primary Examiner* — Carlos Lugo
*Assistant Examiner* — Thomas Neubauer
(74) *Attorney, Agent, or Firm* — Buchanan Ingersoll & Rooney PC

(57) ABSTRACT

A vehicle door fixing apparatus includes a door lock striker configured to be provided at one of a vehicle body panel and a door panel, a door lock assembly configured to be provided at the other one of the vehicle body panel and the door panel, a latch mechanism, a wedge member, and a fastening member including a fastening member head portion configured to protrude from a panel surface, the fastening member fastening the door lock assembly, the fastening member head portion including a contact portion which comes in contact with an inclined surface of the wedge member in response to a closing operation of the vehicle door, wherein a vehicle door is fixed in a closed state in a case where the door lock striker engages with the latch mechanism in response to the closing operation of the vehicle door.

8 Claims, 4 Drawing Sheets

VEHICLE DOOR FIXING APPARATUS AND FASTENING MEMBER

CROSS REFERENCE TO RELATED APPLICATIONS

This application is based on and claims priority under 35 U.S.C. §119 to Japanese Patent Application 2012-197088, filed on Sep. 7, 2012, the entire content of which is incorporated herein by reference.

TECHNICAL FIELD

This disclosure generally relates to a vehicle door fixing apparatus and a fastening member.

BACKGROUND DISCUSSION

A vehicle door fixing apparatus is conventionally known, where a door lock striker provided at one of the vehicle door (a door panel) and a door opening portion (a vehicle body panel) engages with a latch mechanism of a door lock assembly provided at the other one of the vehicle door and the door opening portion on the basis of, that is, in response to, a closing operation of the vehicle door, and thus a vehicle door is fixed in a closed state.

According to some of the known vehicle door fixing apparatuses described above, a wedge member is provided at each of the vehicle panel and the door panel in such a manner that inclined surfaces of the respective wedge members are in contact with each other, and any of the wedge members is biased and pressed against the other one of the wedge members, in response to the closing operation of the vehicle door (for example, see JP2012-97495A (hereinafter referred to as Patent reference 1).

That is, on the basis of a force that the inclined surfaces, which are in contact with each other, push each other, the vehicle door in the closed state is pushed in a direction intersecting with an opening/closing direction of the vehicle door, that is, the vehicle door is pushed toward a hinge portion side serving as a fulcrum point of movement of the closing operation of the vehicle door, for example. Accordingly, looseness or backlash of the vehicle door is restricted with a simple configuration.

However, configurations of the vehicle panel and/or the door panel differ from one another depending on a vehicle model. Thus, for example, configurations of the wedge members arranged on panel surfaces of the respective vehicle body panel and the door panel, and/or a configuration of a bracket fixing the wedge members need to be changed in order to correspond to the configuration of the vehicle panel and the door panel. This might cause a complicated control work of part numbers and/or an increase in manufacturing costs.

A need thus exists for a vehicle door fixing apparatus and a fastening member thereof, which is not susceptible to the drawback mentioned above.

SUMMARY

According to an aspect of this disclosure, a vehicle door fixing apparatus includes a door lock striker configured to be provided at one of a vehicle body panel and a door panel, a door lock assembly configured to be provided at the other one of the vehicle body panel and the door panel, a latch mechanism provided at the door lock assembly, a wedge member configured to be arranged at a panel surface of the one of the vehicle body panel and the door panel, the door lock striker configured to be provided at the one of the vehicle body panel and the door panel, and a fastening member including a fastening member head portion configured to protrude from a panel surface of the other one of the vehicle body panel and the door panel, the fastening member fastening the door lock assembly, the fastening member head portion including a contact portion which comes in contact with an inclined surface of the wedge member in response to a closing operation of a vehicle door, the wedge member being biased in a direction in which the inclined surface is pushed against the contact portion of the fastening member head portion, wherein the vehicle door is fixed in a closed state in a case where the door lock striker engages with the latch mechanism in response to the closing operation of the vehicle door.

According to an aspect of this disclosure, a fastening member configured to be applied to a vehicle door fixing apparatus including a door lock striker configured to be provided at one of a vehicle body panel and a door panel, a door lock assembly configured to be provided at the other one of the vehicle body panel and the door panel, a latch mechanism provided at the door lock assembly, wherein a vehicle door is fixed in a closed state in a case where the door lock striker engages with the latch mechanism in response to a closing operation of the vehicle door, the fastening member includes a fastening member head portion configured to protrude from a panel surface of the other one of the vehicle body panel and the door panel, the fastening member fastening the door lock assembly, the fastening member head portion including a contact portion which comes in contact with an inclined surface of a wedge member configured to be arranged at a panel surface of the one of the vehicle body panel and the door panel in response to the closing operation of the vehicle door, the door lock striker configured to be provided at the one of the vehicle body panel and the door panel.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
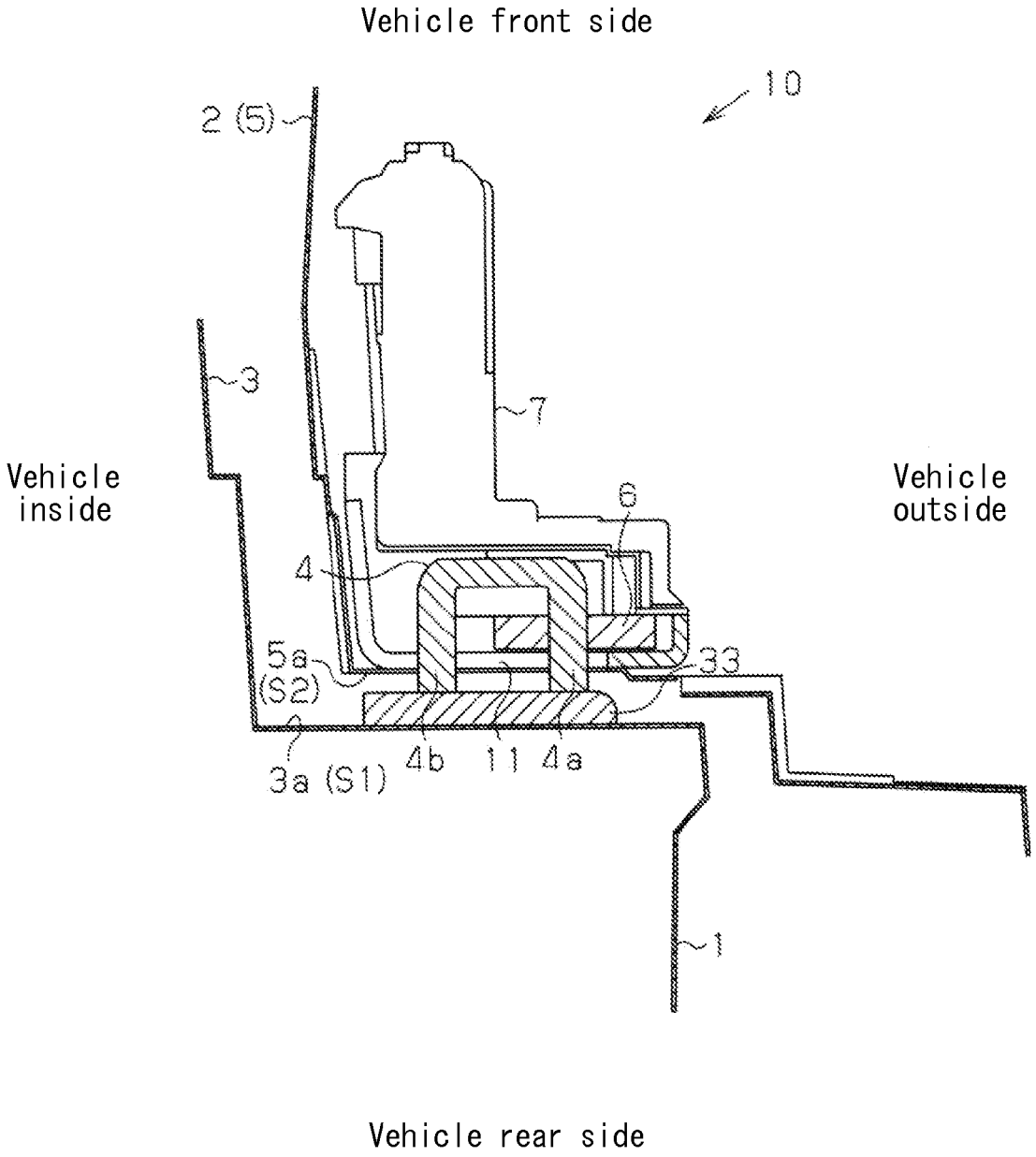
FIG. 1 is a cross-sectional view illustrating a schematic configuration of a vehicle door fixing apparatus according to an embodiment disclosed here.

An embodiment of this disclosure will be explained with reference to the drawings. As illustrated in FIG. 1, at a vehicle body panel 1 (a side member outer panel) forming a side surface of a vehicle, a door lock striker 4 is provided at a side end surface 3*a* of a door opening portion 3 to which a vehicle door 2 is attached. The door lock striker 4 includes an outer shape of substantially a shape of the letter U and is formed to protrude from a panel surface S1 of the vehicle body panel 1. In addition, a door lock assembly 7 is provided at a door panel 5 (a door inner panel) forming the vehicle door 2. The door lock assembly 7 includes a latch mechanism 6 of a known type, which the door lock striker 4 engages with and disengages from on the basis of, that is, in response to, opening and closing operations or opening and closing operations movement of the vehicle door 2. Accordingly, the door lock assembly 7 maintains a state where the latch mechanism 6 and the door lock striker 4 are engaged with each other, and thus a vehicle door fixing apparatus 10 of the embodiment fixes the vehicle door 2 in a closed state.

In further detail, the vehicle door 2 illustrated in FIG. 1 is a side door provided at a right side of the vehicle. The vehicle door 2 performs the opening and closing operations relative to a hinge portion which is provided at a side end surface of the vehicle door 2 at a vehicle front side (that is, at an upper side in FIG. 1) at the door opening portion 3 and which serves as a fulcrum point of the opening and closing movement of the vehicle door 2. The door lock striker 4 is fixed to the side end surface 3*a* of the door opening portion 3 in a manner that two leg portions 4*a*, 4*b* of the door lock striker 4, each protruding from the panel surface S1, are arranged on a linear line that substantially matches a direction of movement of the door panel 5 when the door panel 5 moves on the basis of the opening and closing operations of the vehicle door 2 (an inside-outside direction of the vehicle, that is, the left/right direction in FIG. 1).

In addition, according to the door panel 5 of the embodiment, a side end surface 5*a* thereof at the vehicle rear side is arranged to face or oppose the side end surface 3*a* of the door opening portion 3 by the closing operation of the vehicle door 2, that is, the side end surface 5*a* faces or oppose the side end surface 3*a* in a case where the vehicle door 2 operates the closing operation and thus the vehicle door 2 is in the closed state. Then, as illustrated in FIG. 2, a striker in/out hole 11 is provided at the door panel 5 to be extended in a direction of a relative movement of the striker in/out hole 11 relative to the door lock striker 4 (see FIG. 1, the left/right direction).

That is, as illustrated in FIG. 1, according to the embodiment, the two leg portions 4*a*, 4*b* of the door lock striker 4 provided at the vehicle body panel 1 appear to go into and go out of the striker in/out hole 11 that opens from a panel surface S2 of the door panel 5 due to the relative movement on the basis of the opening and closing operations of the vehicle door 2. The door lock assembly 7 is fastened inside the door panel 5 (that is, inside the panel) so that the latch mechanism 6 of the door lock assembly 7 is arranged at a position that faces the striker in/out hole 11.

Figure 2:
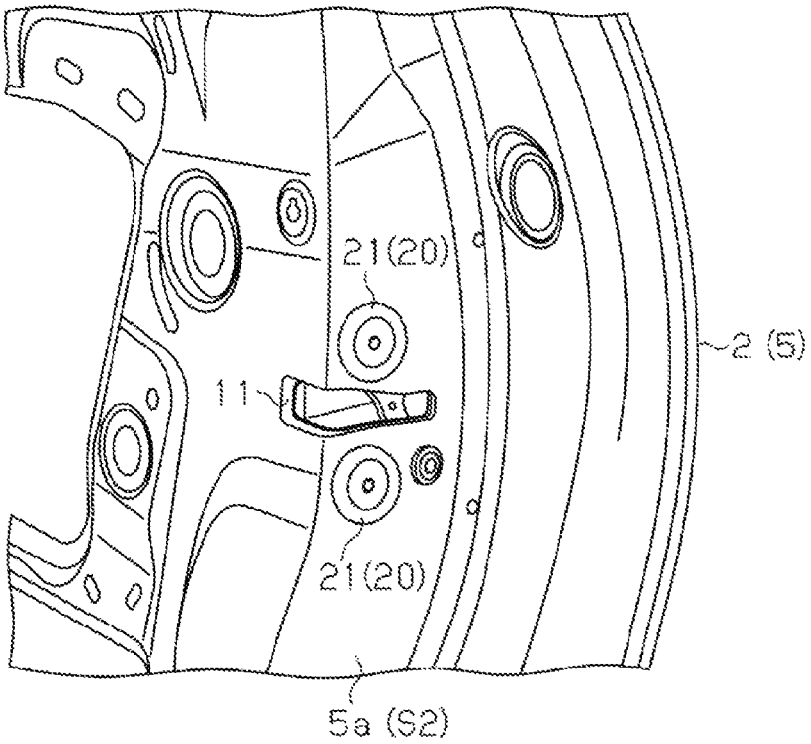
FIG. 2 is a perspective view of a side end surface (a door panel) of a vehicle door and of a striker in/out hole which opens at a panel surface of the door panel according to the embodiment.
Figure 3:
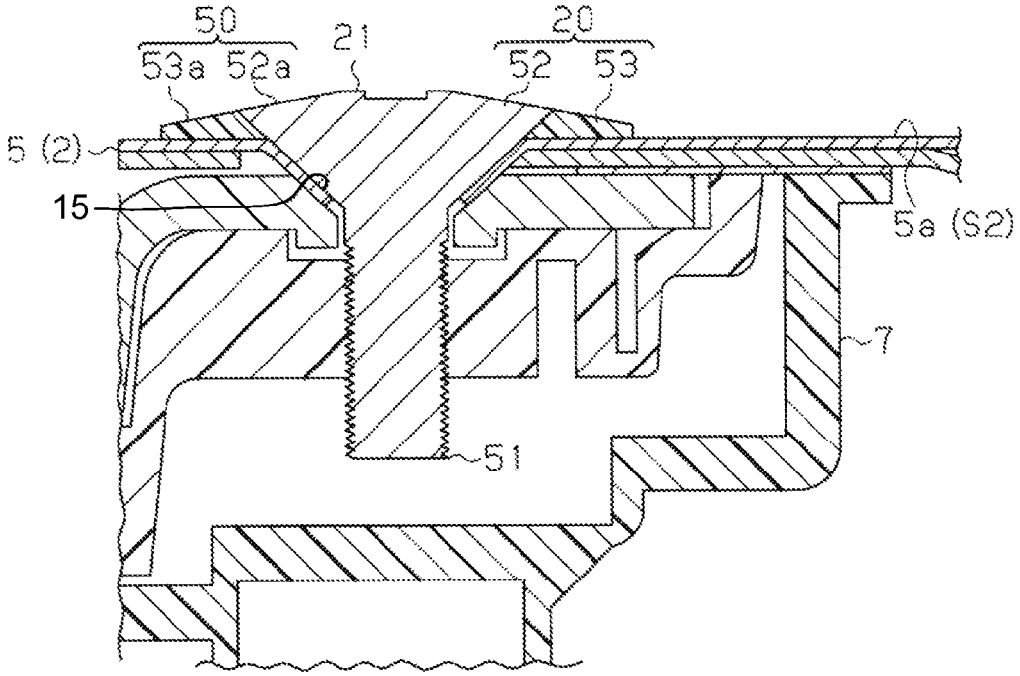
FIG. 3 is a cross-sectional view illustrating a door lock assembly arranged at an inner side of the door panel and of a screw member fastening the door lock assembly according to the embodiment.

Specifically, as illustrated in FIGS. 2 and 3, a pair of through holes 15 are formed in a vicinity of the striker in/out hole 11 in a manner that the through holes 15 are arranged at positions with the striker in/out hole 11 interposed therebetween. The through holes 15 are substantially symmetrically positioned to each other relative to the striker in/out hole 11. In addition, a screw member 21 is attached by insertion to each of the through holes 15 in a manner that a fastening member head portion (i.e., a screw head portion 20) of each of the screw members 21 protrudes from the panel surface S2. Accordingly, the door lock assembly 7 is fastened inside the door panel 5 by means of a tightening force or fastening force of each of the screw members 21 serving as fastening members.

Figure 4:
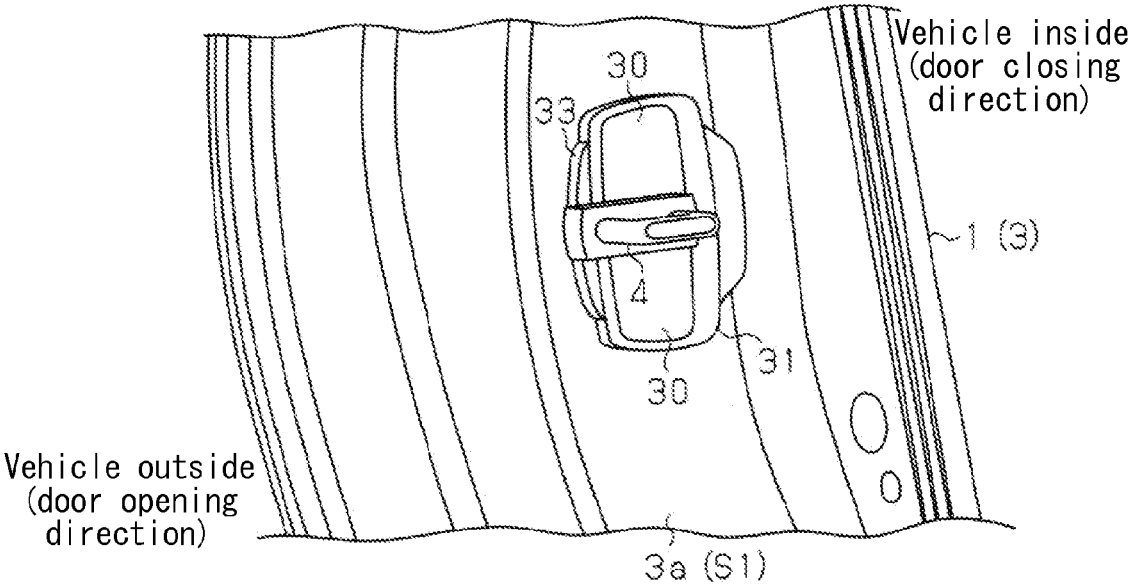
FIG. 4 is a perspective view of a side end surface (a vehicle body panel) of a door opening portion, and of a door lock striker and a wedge member which are provided at a panel surface of the vehicle body panel according to the embodiment.

In addition, as illustrated in FIG. 4, at the panel surface S1 of the vehicle body panel 1, at the side end surface 3*a* of the door opening portion 3 where the door lock striker 4 is provided, a wedge member 31 including an inclined surface 30 is arranged. The inclined surface 30 intersects with a direction of a relative movement of the vehicle door 2 (the door panel 5) relative to the vehicle body panel 1 (that is, the substantially left/right direction in FIG. 4). In the embodiment, the screw head portion 20 of each of the screw members 21 is in contact with the inclined surface 30 of the wedge member 31 on the basis of the closing operation of the vehicle door 2.

Figure 5:
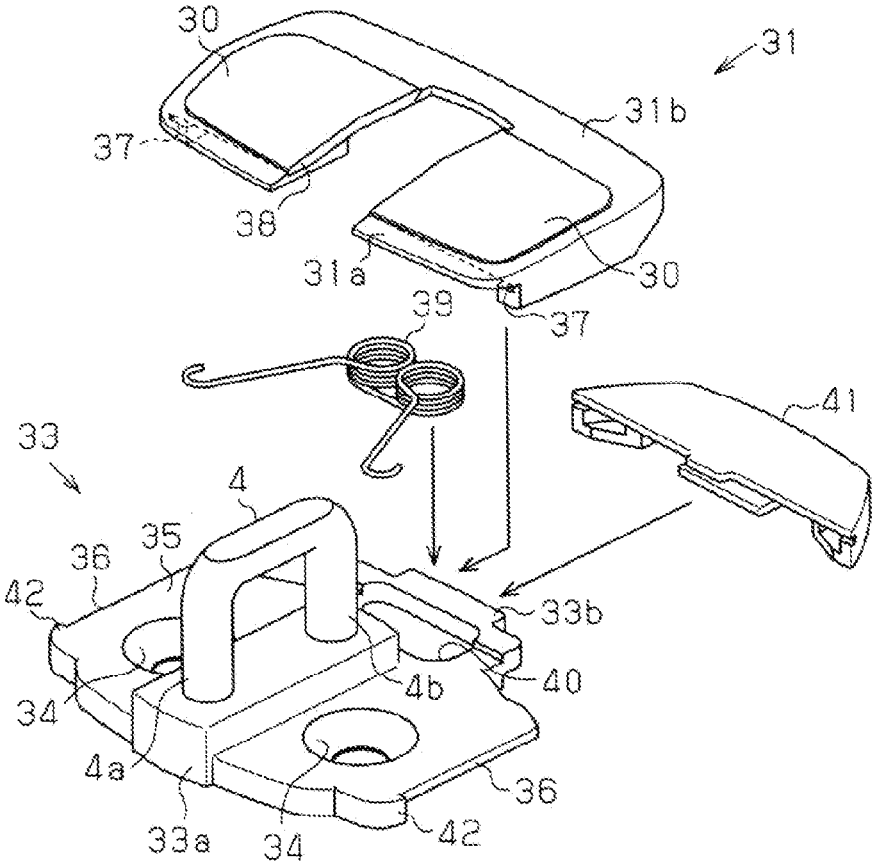
FIG. 5 is an exploded perspective view illustrating a fixing structure of the door lock striker and the wedge member according to the embodiment.

In further detail, as illustrated in FIGS. 4 and 5, according to the embodiment, the door lock striker 4 is arranged in a standing condition at a base plate 33 including a shape of a substantially flat plate. In a state where the base plate 33 is fixed at the door opening portion 3, a direction connecting the leg portions 4*a* and 4*b* of the door lock striker 4 with each other corresponds to "a front/rear direction" of the base plate 33, and a direction which is orthogonal to the front/rear direction corresponds to "a width direction" of the base plate 33. The door lock striker 4 is provided at a width-direction central portion of the base plate 33. The door lock striker 4 is fixed to the side end surface 3*a* of the door opening portion 3 integrally with the base plate 33 in the manner that the direction connecting the leg portions 4*a* and 4*b* of the door lock striker 4 with each other matches the direction of the movement of the door panel 5 on the basis of the opening and closing operations of the vehicle door 2 (that is, a substantially left/right direction in FIG. 4).

The base plate 33 of the embodiment includes a pair of through holes 34. The through holes 34 are provided at respective side portions of the base plate 33 in the width direction with the door lock striker 4 interposed between the through holes 34. According to the embodiment, the base plate 33 and the door lock striker 4 are fixed to the side end surface 3*a* of the door opening portion 3 by means of a bolt inserted through each of the through holes 34.

The wedge member 31 of the embodiment is attached to the base plate 33 so as to cover an upper surface 35 of the base plate 33, at which the door lock striker 4 is arranged in the standing condition as explained above. Specifically, as illustrated in FIG. 5, a guide rail 36 is provided at each width-direction end of the base plate 33 to be extended in the front/rear direction of the base plate 33. On the other hand, a guide groove 37, in which the corresponding guide rail 36 is fitted, is provided at each end portion of the wedge member 31 in the width direction. The end portions of the wedge member 31 in the width direction are arranged at the respective width-direction ends of the base plate 33 in a state where the wedge member 31 is attached to the base plate 33. Here, the end portions of the wedge member 31, at which the respective guide grooves 37 are provided, correspond to width-direction ends of the wedge member 31. At a width-direction central portion of the wedge member 31, a slit 38 is provided. The slit 38 is formed by cutting out a front end portion 31*a* of the wedge member 31 so that the slit 38 extends in the front/rear direction in a state where the wedge member 31 is attached to the base plate 33. The wedge member 31 of the embodiment includes the inclined surface 30 provided at each side in the width direction relative to the slit 38 so as to be inclined from a rear end portion 31*b* of the wedge member 31 toward the front end portion 31*a* thereof.

That is, the wedge member 31 of the embodiment is brought to be attached to the base plate 33 from a side at which a rear end portion 33*b* of the base plate 33 is provided in a manner that the guide rails 36 are inserted into the respective guide grooves 37 provided at the width-direction ends of the wedge member 31. By having (the two leg portions 4*a*, 4*b* of) the door lock striker 4 inserted in the slit 38, the inclined surfaces 30, which intersect with the direction of the relative movement of the vehicle door 2, are arranged at positions with the door lock striker 4 interposed therebetween in the width direction.

In addition, the wedge member 31 of the embodiment is movable on the base plate 33 in the front/rear direction on the basis of the fitting or engagement of the guide grooves 37 provided at the wedge member 31 and the respective guide rails 36 provided at the base plate 33 with each other. Further, according to the embodiment, a hole portion 40 in which a torsion coil spring 39 is accommodated is provided at the width-direction central portion of the base plate 33 at a more rearward portion than (the leg portion 4*b* of) the door lock striker 4, that is, at the rear end portion 33*b*. The wedge member 31 is biased by an elastic force of the torsion coil spring 39 toward a front end portion 33*a* of the base plate 33, that is, in a direction opposite to the direction of the relative movement of the door panel 5 on the basis of the closing operation of the vehicle door 2.

A cover 41 covering above the torsion coil spring 39 is attached to the rear end portion 33*b* of the base plate 33. In addition, a stopper 42 is provided at each of the guide rails 36, at a side portion of the guide rail 36 which is positioned closer to the front end portion 33*a* of the base plate 33. According to the embodiment, the wedge member 31 is restricted by the stoppers 42 from moving forward.

That is, as illustrated in FIGS. 2 and 4, at the side end surface 3*a* of the door opening portion 3 and the side end surface 5*a* of the door panel 5 which come to face each other in response to the closing operation of the vehicle door 2, the inclined surfaces 30 of the wedge member 31 protruding from the panel surface S1 are provided in a manner that the positions of the inclined surfaces 30 with the door lock striker 4 interposed therebetween are substantially symmetrical to each other relative to the door lock striker 4. The screw head portions 20 of the respective screw members 21 which protrude from the panel surface S2 are provided in a manner that the positions of the screw head portions 20 with the striker in/out hole 11 interposed therebetween are substantially symmetrical to each other relative to the striker in/out hole 11.

Figure 6:
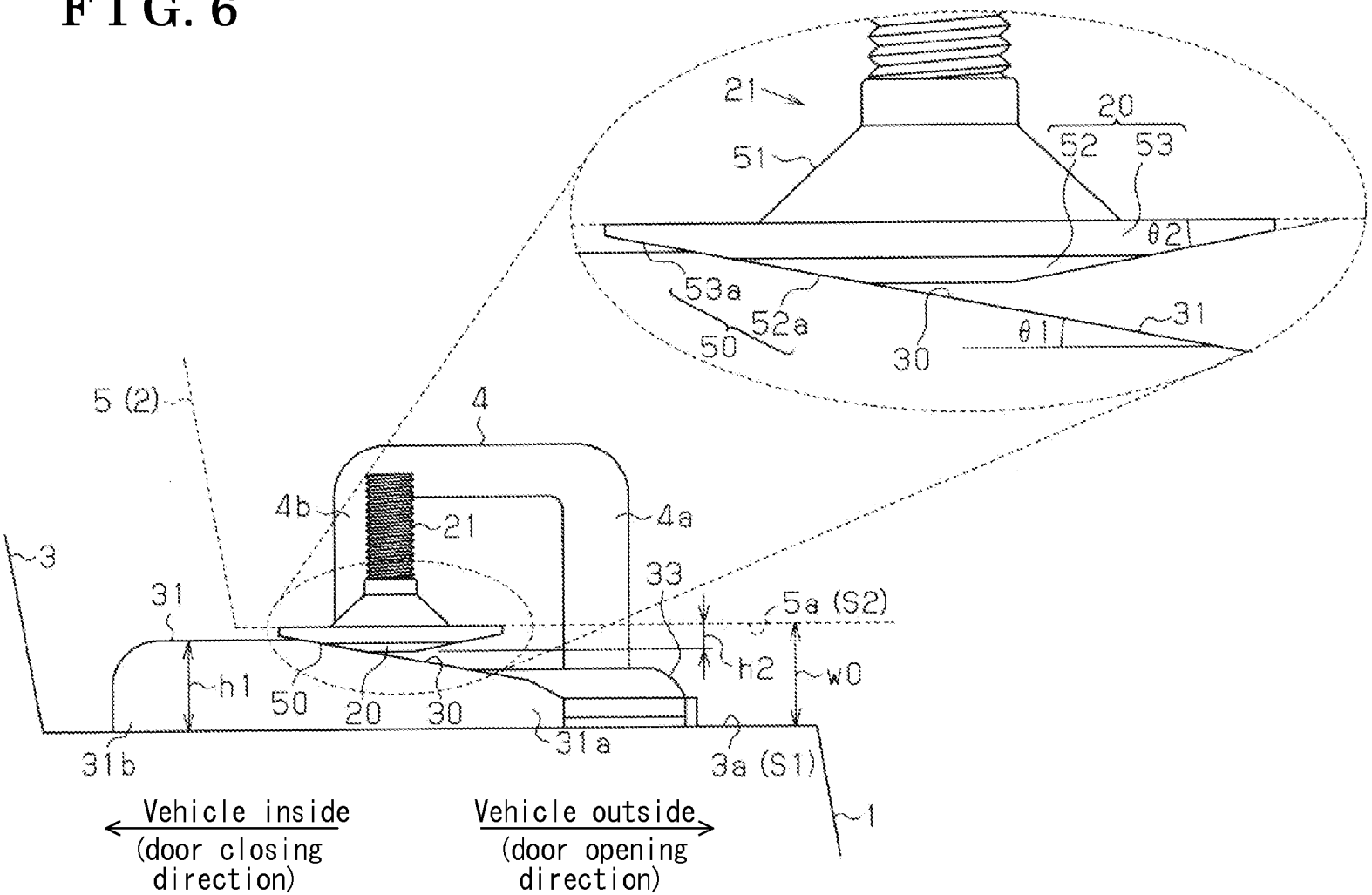
FIG. 6 is a side view of the wedge member and the screw member.

In addition, as illustrated in FIG. 6, a protruding height h1 of the wedge member 31 protruding from the panel surface S1 of the vehicle body panel 1 and a protruding height h2 of each of the screw head portions 20 protruding from the panel surface S2 of the door panel 5 are set so that a total height of the protruding height h1 and the protruding height h2 is larger than a distance w0 between the panel surface S1 of the vehicle body panel 1 and the panel surface S2 of the door panel 5 when the vehicle door 2 is in the closed state (h1+h2>w0). Thus, according to the embodiment, the screw head portions 20 of the screw members 21 are configured to be in contact with the respective inclined surfaces 30 of the wedge member 31 on the basis of the closing operation of the vehicle door 2.

In further detail, according to the embodiment, the screw head portion 20 of each of the screw members 21 includes an outer shape of a substantially conical shape, more specifically, a shape of a circular truncated cone having a small flat surface formed at a top portion thereof. At the flat surface at the top portion of the screw head portion 20, a hexagon socket which is used for tightening the screw is provided (see FIGS. 2 and 3). A slope portion 50, which is provided at each of the screw head portions 20 and includes an inclination that is substantially uniform over an entire circumference of the screw head portions 20, is in contact with the corresponding inclined surface 30 of the wedge member 31 when the vehicle door 2 is in the closed state.

In further detail, as illustrated in FIG. 3, each of the screw members 21 of the embodiment is formed by fixing a circular annular portion 53 made of resin and including a tapered surface 53*a* to a head portion 52 (i.e., a fastening body head portion) of a metal screw 51 (i.e., a fastening body). The tapered surface 53*a* forms the slope portion 50 together with an outer surface 52*a* of the head portion 52. Specifically, the screw member 21 of the embodiment is formed by insert molding, where the metal screw 51 serves as an insert and the circular annular portion 53 is formed at an outer periphery of the head portion 52 of the metal screw 51. According to the configuration of the embodiment, an area of the slope portion 50 is increased as described above.

In addition, as illustrated in FIG. 6, an inclination θ2 of the slope portion 50 is set at an angle which is substantially identical to an inclination θ1 of each of the inclined surfaces 30 of the wedge member 31. Here, the inclination "θ1" corresponds to an angle formed by each of the inclined surfaces 30 of the wedge member 31 relative to the side end surface 3*a* (the panel surface S1) of the door opening portion 3 which expands in the direction of the relative movement of the vehicle door 2 on the basis of the opening and closing operations thereof (that is, the left/right direction in FIG. 6). The inclination "θ2" corresponds to an angle formed by the slope portion 50 of each of the screw head portions 20 relative to the side end surface 5*a* (the panel surface S2) of the door panel 5 which expands in the direction of the relative movement of the vehicle door 2 on the basis of the opening and closing operations thereof (that is, the left/right direction in FIG. 6). Thus, according to the embodiment, a larger area of contact between the inclined surface 30 of the wedge member 31 and the slope portion 50 of the screw head portion 20 is assured.

Next, an operation of the vehicle door fixing apparatus, which is configured as stated above, will be explained. According to the embodiment, by means of the closing operation of the vehicle door 2, the slope portion 50 of each of the screw head portions 20 protruding from the panel surface S2 of (the side end surface 5*a* of) the door panel 5 is in contact with the corresponding inclined surface 30 of the wedge member 31 arranged on the panel surface S1 of (the side end surface 3*a* of the door opening portion 3 of) the vehicle body panel 1. In addition, the wedge member 31 is biased by the torsion coil spring 39, which serves as an elastic member making up a biasing mechanism, in the direction opposite to the direction of the relative movement of the door panel 5 during the closing operation thereof. That is, the wedge member 31 is biased in a direction in which the inclined surfaces 30 are pushed against the slope portion 50 of the respective screw head portions 20. Thus, the vehicle door 2 in the closed state is pushed in a direction intersecting with an opening/closing direction of the vehicle door 2 on the basis of a force that the inclined surfaces 30 of the wedge member 31 and the slope portions 50 of the respective screw head portions 20, which are in contact with each other, push each other.

Here, according to the embodiment, the inclination θ1 of each of the inclined surfaces 30 of the wedge member 31 and the inclination θ2 of the slope portion 50 of each of the screw head portions 20 are set so that the vehicle door 2 is pushed toward the vehicle front side (see FIG. 1, the upper side in FIG. 1) where the hinge portion is provided. Thus, looseness or backlash of the vehicle door 2 is restricted with a simple configuration.

In addition, by "reducing the looseness or backlash", the vehicle door 2 functions as a structural body (a supporting member) which extends in the front/rear direction of the door opening portion 3. Thus, according to the embodiment, a vehicle rigidity is increased, and accordingly a turning performance of the vehicle might increase.

For example, in a case where the vehicle turns, a bending deformation occurs to the vehicle body due to a centrifugal force. However, because the wedge member 31, which is pushed against the screw head portions 20, moves to follow the bending deformation, a contact state between the inclined surfaces 30 of the wedge member 31 and the slope portions 50 of the respective screw head portions 20 is maintained. Thus, according to the embodiment, the bending deformation can be minimized.

According to the aforementioned embodiment, the following effects and advantages are obtained. (1) The door lock assembly 7, which makes up the vehicle door fixing apparatus 10 together with the door lock striker 4 provided at the vehicle body panel 1, is fastened inside the door panel 5 by means of the screw members 21 each of which includes the screw head portion 20 protruding on the panel surface S2. In addition, the wedge member 31 including the inclined surfaces 30 intersecting with the direction of the relative movement of the vehicle door 2 (the door panel 5) is provided at the panel surface S1 of the vehicle body panel 1. The slope portion 50, which is in contact with the corresponding inclined surface 30 on the basis of, that is, in response to, the closing operation of the vehicle door 2, is provided at the screw head portion 20 of each of the screw members 21. The wedge member 31 is biased in the direction in which the inclined surfaces 30 thereof are pushed against the slope portions 50 of the respective screw head portions 20.

According to the above-explained configuration, on the basis of the force that the inclined surfaces 30 of the wedge member 31 and the slope portion 50 of each of the screw head portions 20 push each other, the vehicle door 2 in the closed state is pushed in the direction intersecting with the opening/closing direction of the vehicle door 2. Thus, the looseness or backlash of the vehicle door 2 is restricted with the simple configuration.

In addition, because each of the screw members 21 is fastened directly to the door panel 5, there is a low probability that a panel configuration obstructs arranging the screw head portions 20 on the panel surface S2. Thus, according to the above-explained configuration, where the screw members 21 are fastened directly to the door panel 5, constraints related to the panel configuration are reduced and a degree of freedom in mounting the screw members 21 on the door panel 5 is increased. Further, the configuration of the embodiment disclosed here is simpler compared to a configuration of a known technique where the wedge member is provided at each of the vehicle body panel 1 and the door panel 5. Accordingly, a reduction in manufacturing costs and a simplified attaching operation are achieved.

(2) The screw member 21 is formed by fixing the circular annular portion 53 made of resin, which includes the tapered surface 53*a* forming the slope portion 50 in cooperation with the outer surface 52*a* of the head portion 52, to the head portion 52 of the metal screw 51.

That is, by fixedly attaching an annular body (the circular annular portion 53) including the tapered surface 53*a* to the head portion 52 of a screw body (the metal screw 51), the slope portion 50 of the screw head portion 20 is expanded easily with the simple configuration. Accordingly, the looseness or backlash is reduced more reliably, and thus the looseness or backlash of the vehicle door 2 is restricted effectively.

(3) In addition, because the head portion 52 of each of the screw bodies made of metal (the metal screws 51) is configured to be in contact with the corresponding inclined surface 30 of the wedge member 31, the vehicle door is pushed more strongly. Thus, the looseness or backlash is reduced more reliably.

(4) Further, because the slope portion 50 is provided over the entire circumference of each of the screw head portions 20, the slope portion 50 is in contact with the corresponding inclined surface 30 of the wedge member 31 more reliably regardless of an orientation of the screw member 21, that is, regardless of a rotational position of the screw head portion 20 in a circumferential direction thereof, in a state where the screw member 21 is fastened. Thus, an operation efficiency might increase because the fastening or tightening operation of the screw member 21 is made easier. Especially, because the slope portion 50 includes the inclination θ2 which is uniform over the entire circumference of the screw head portion 20, more remarkable advantages and effects are obtained.

(5) The pair of screw head portions 20 is arranged on the panel surface S2 in a manner that the screw head portions 20 are arranged at positions with the striker in/out hole 11 interposed therebetween. The screw head portions 20 are substantially symmetrically positioned to each other relative to the striker in/out hole 11. Due to the above-explained configuration, the vehicle door 2 is pushed in a well-balanced manner. Thus, the looseness or backlash is reduced more reliably.

The aforementioned embodiment can be changed or modified as follows. In the aforementioned embodiment, the door lock striker 4 is provided at the vehicle body panel 1 and the door lock assembly 7 is provided at the door panel 5. However, the configuration is not limited thereto, and the door lock assembly 7 can be provided at the vehicle body panel 1 and the door lock striker 4 can be provided at the door panel 5.

In the aforementioned embodiment, the vehicle door fixing apparatus 10 is applied to the vehicle door 2 which performs the opening and closing operation relative to the hinge portion serving as the support point of the operation, more specifically, the vehicle door fixing apparatus 10 is applied to the side door on the right side of the vehicle body. However, the application of the vehicle door fixing apparatus 10 is not limited thereto and can be applied to a so-called slide door or alternatively, to a back door which opens/closes an opening portion provided at a vehicle rear end.

In the aforementioned embodiment, the door lock assembly 7 is fastened inside the door panel 5. However, the door lock assembly 7 can be fastened to the door panel 5 in a manner that at least part of the door lock assembly 7 is exposed to the panel surface S2 as long as the screw head portions 20 of the respective screw members 21 fastening the door lock assembly 7 protrude from the panel surface S2.

In the aforementioned embodiment, the pair of screw head portions 20 is arranged on the panel surface S2 in a manner that the positions of the screw head portions 20 are substantially symmetrical to each other across the striker in/out hole 11 with the striker in/out hole 11 interposed between the screw head portions 20. However, the number of the screw members 21 fastening the door lock assembly 7 is not limited thereto, and can be arbitrarily changed. In addition, the number of the screw head portions 20 provided to protrude from the panel surface S2, and arrangement or layout thereof can be arbitrarily changed.

In the aforementioned embodiment, the screw member 21 is manufactured by way of the insert molding where the metal screw 51 serves as the insert. However, the screw member 21 can be formed by fastening the circular annular portion 53 including the tapered surface 53*a* corresponding to the slope portion 50 together, by means of the head portion 52 of the metal screw 51. Also in this configuration, where the screw member 21 is formed by fastening the circular annular portion 53 together, the slope portion 50 of the screw head portion 20 is expanded or increased easily. Then, the screw member 21 can be formed by a single screw body.

In addition, the screw member 21 can be made of a single material. For example, the annular body (the circular annular portion 53) can be made of metal material. Further, each of the screw body and the annular body can be made of non-metal material. Further, one of the screw body and the annular body can be made of metal material, and the other one of the screw body and the annular body can be made of non-metal material.

In the aforementioned embodiment, the screw head portion 20 of each of the screw members 21 includes the outer shape of the substantially conical shape. However, the outer shape of the screw member 21 is not limited thereto and can be modified arbitrarily as long as the outer shape of the screw member 21 includes the slope portion 50 which is in contact with the inclined surface 30 of the wedge member 31 on the basis of the closing operation of the vehicle door 2. For example, an annular body other than the circular annular portion 53 can be used.

However, by forming the screw head portion 20 into the substantially conical shape, the slope portion 50 which includes the substantially uniform inclination over the entire circumference of the screw head portion 20 is formed. Consequently, from the viewpoint of bringing the slope portion 50 in contact with the inclined surface 30 of the wedge member 31 more reliably, the configuration of the screw head portion 20 which is explained in the aforementioned embodiment is desirable. For example, in a case where the outer shape of the screw head portion 20 is formed in a polygonal pyramid configuration, the slope portion 50 is provided over the entire circumference of the screw head portion 20, although the slope portion 50 in this case is formed in a circumferentially-discontinuous manner.

In the aforementioned embodiment, the biasing mechanism biasing the wedge member 31 is made up of the torsion coil spring 39 serving as the elastic member. However, in order to bias the wedge member 31, a spring member other than the torsion coil spring 39 can be used or an elastic member other than the spring member can be used.

In the aforementioned embodiment, the door lock assembly 7 is fastened inside the door panel 5 by means of the tightening force of each of the screw members 21. At the screw head portion 20 of each of the screw members 21, the slope portion 50, which is brought in contact with the corresponding inclined surface 30 of the wedge member 31 on the basis of the closing operation of the vehicle door 2, is provided. However, the contact portion being in contact with the inclined surface 30 of the wedge member 31 does not need to be the slope portion 50 as explained in the aforementioned embodiment.

In addition, the door lock assembly 7 can be fastened by means of a fastening member of another type, instead of the screw member 21. For example, a rivet or the like can be used as a fastening body of another type which is an alternative to the screw body (the metal screw 51). In this case, a contact portion such as the slope portion 50, which is in contact with the corresponding inclined surface 30 of the wedge member 31, can be provided at a head portion of the fastening member. With this configuration, effects and advantages likewise the aforementioned embodiment are attained.

Next, technical ideas which can be obtained from the aforementioned embodiment, and advantages and effects thereof will be described. (A) The fastening body corresponds to the metal screw. Thus, a metal portion is provided easily at the slope portion.

(B) The fastening member is formed by fastening or tightening the annular body, which includes the tapered surface serving as the slope portion, together by means of the head portion of the fastening body. Thus, the slope portion of the head portion is expanded easily.

(C) The slope portion includes the uniform inclination over the entire circumference.

According to the aforementioned embodiment, the vehicle door fixing apparatus 10 includes the door lock striker 4 configured to be provided at one of the vehicle body panel 1 and the door panel 5, the door lock assembly 7 configured to be provided at the other one of the vehicle body panel 1 and the door panel 5, the latch mechanism 6 provided at the door lock assembly 7, the wedge member 31 configured to be arranged at the panel surface S1, S2 of the one of the vehicle body panel 1 and the door panel 5, the door lock striker 4 configured to be provided at the one of the vehicle body panel 1 and the door panel 5, and the screw member 21 including the screw head portion 20 configured to protrude from the panel surface S1, S2 of the other one of the vehicle body panel 1 and the door panel 5, the screw member 21 fastening the door lock assembly 7, the screw head portion 20 including the contact portion (i.e., the slope portion) 50 which comes in contact with the inclined surface 30 of the wedge member 31 in response to the closing operation of the vehicle door 2, the wedge member 31 being biased in the direction in which the inclined surface 30 is pushed against the slope portion 50 of the screw head portion 20, wherein the vehicle door 2 is fixed in the closed state in a case where the door lock striker 4 engages with the latch mechanism 6 in response to the closing operation of the vehicle door 2.

According to the above-described configuration, the vehicle door 2 in the closed state is pushed in the direction intersecting with the opening/closing direction of the vehicle door 2 on the basis of the force that the inclined surfaces 30 of the wedge member 31 and the slope portion 50 defined at the screw head portion 20 of each of the screw members 21 push each other. Thus, the looseness or backlash of the vehicle door 2 is restricted with the simple configuration.

In addition, because the screw members 21 are fastened directly relative to the panel member (that is, the door panel 5 or the vehicle body panel 1), there is a low probability that the panel configuration obstructs arranging the screw head portions 20 on the panel surface. Thus, according to the above-explained configuration, the constraints related to the panel configuration are reduced and the flexibility in mounting the screw members 21 on the panel member is increased. Further, the configuration described above is simpler compared to the configuration of the known technique where the wedge member 31 is provided at each of the vehicle body panel 1 and the door panel 5. Accordingly, the reduction in the manufacturing costs and the simplified attaching operation are achieved.

According to the above-described configuration, the constraints related to the panel configuration are reduced, and thus the degree of freedom of mountability is increased.

According to the aforementioned embodiment, the contact portion 50 corresponds to the slope portion 50, and the slope portion 50 is formed over the entire circumference of the screw head portion 20.

According to the above-described configuration, the slope portion 50 is in contact with the corresponding inclined surface 30 of the wedge member 31 more reliably regardless of the orientation of the screw member 21, that is, regardless of the rotational position of the screw head portion 20 in the circumferential direction thereof, in a state where the screw member 21 is tightened. Thus, the operation efficiency might increase because the fastening operation of the screw member 21 is made easier.

According to the aforementioned embodiment, the contact portion 50 corresponds to the slope portion 50, and the screw member 21 includes the metal screw 51 including the head portion 52, the screw member 21 includes the circular annular portion 53 including the tapered surface 53*a* forming the slope portion 50, and the annular body 53 is fixed to the head portion 52 of the fastening body 51.

According to the above-described configuration, the slope portion 50 serving as the contact portion is expanded easily with the simple configuration. Consequently, the looseness or backlash can be reduced more reliably, and thus the looseness of the vehicle door 2 is restricted effectively.

According to the aforementioned embodiment, The vehicle door fixing apparatus 10 according to claim 1, further includes the striker in/out hole 11 configured to be provided at the other one of the vehicle body panel 1 and the door panel 5, wherein the door lock striker 4 engages with and disengages from the latch mechanism 6 of the door lock assembly 7 via the striker in/out hole 11 configured to open at the panel surface S1, S2 of the other one of the vehicle body panel 1 and the door panel 5, and the screw head portion 20 is arranged at plural positions with the striker in/out hole 11 interposed therebetween.

According to the above-described configuration, the vehicle door 2 is pushed in the well-balanced manner. Thus, the looseness or backlash of the vehicle door 2 is reduced more reliably.

According to the aforementioned embodiment, the contact portion 50 corresponds to the slope portion 50 and the screw head portion 20 includes the metal portion forming the slope portion 50.

According to the above-described configuration, the vehicle door 2 is pushed more strongly. Thus, the looseness or backlash of the vehicle door 2 is reduced more reliably.

According to the above-described configuration, the screw member 21 is configured to be applied to the vehicle door fixing apparatus 10 including the door lock striker 4 configured to be provided at one of the vehicle body panel 1 and the door panel 5, the door lock assembly 7 configured to be provided at the other one of the vehicle body panel 1 and the door panel 5, the latch mechanism 6 provided at the door lock assembly 7, wherein the vehicle door 2 is fixed in the closed state in a case where the door lock striker 4 engages with the latch mechanism 6 in response to the closing operation of the vehicle door 2, the screw member 21 includes the screw head portion 20 configured to protrude from the panel surface S1, S2 of the other one of the vehicle body panel 1 and the door panel 5, the screw member 21 fastening the door lock assembly 7, the screw head portion 20 including the contact portion (i.e., the slope portion) 50 which comes in contact with the inclined surface 30 of the wedge member 31 configured to be arranged at the panel surface S1, S2 of the one of the vehicle body panel 1 and the door panel 5 in response to the closing operation of the vehicle door 2, the door lock striker 4 configured to be provided at the one of the vehicle body panel 1 and the door panel 5.

According to the aforementioned embodiment, the vehicle door 2 in the closed state is pushed in the direction intersecting with the opening/closing direction of the vehicle door 2 on the basis of the force which the slope portion 50 provided at each of the screw head portions 20 and the corresponding inclined surface 30 of the wedge member 31 push each other (the force which is generated by the contact between the slope portion 50 and the inclined surface 30). Thus, the looseness or backlash of the vehicle door 2 is restricted with the simple configuration.

In addition, because each of the screw members 21 is fixed directly to the panel members (that is, the door panel 5 or the vehicle body panel 1), there is a low probability that the panel configuration obstructs arranging the screw head portions 20 on the panel surface. Thus, according to the above-explained configuration, the constraints related to the panel configuration are reduced and the degree of freedom in mountability of the screw members 21 on the panel members is increased.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle door fixing apparatus, comprising:

a door lock striker configured to be provided at one of a vehicle body panel and a door panel;

a door lock assembly configured to be provided at the other one of the vehicle body panel and the door panel;

a latch mechanism provided at the door lock assembly;

a wedge member configured to be arranged at a panel surface of said one of the vehicle body panel and the door panel, the door lock striker configured to be provided at said one of the vehicle body panel and the door panel; and a fastening member including a fastening member head portion configured to protrude from a panel surface of the other one of the vehicle body panel and the door panel, the fastening member fastening the door lock assembly, the fastening member head portion including a contact portion which comes in contact with an inclined surface of the wedge member in response to a closing operation of a vehicle door, the wedge member being biased in a direction in which the inclined surface is pushed against the contact portion of the fastening member head portion, the contact portion corresponding to a slope portion, the slope portion being formed over an entire circumference of the fastening member head portion, wherein the vehicle door is fixed in a closed state in a case where the door lock striker engages with the latch mechanism in response to the closing operation of the vehicle door.

2. The vehicle door fixing apparatus according to claim 1, wherein the fastening member includes a fastening body including a fastening body head portion, the fastening member includes an annular body including a tapered surface forming the slope portion, and the annular body is fixed to the fastening body head portion of the fastening body.

3. The vehicle door fixing apparatus according to claim 1, further comprising:

a striker in/out hole configured to be provided at the other one of the vehicle body panel and the door panel, wherein the door lock striker engages with and disengages from the latch mechanism of the door lock assembly via the striker in/out hole configured to open at the panel surface of the other one of the vehicle body panel and the door panel, and the fastening member head portion is arranged at a plurality of positions with the striker in/out hole interposed therebetween.

4. The vehicle door fixing apparatus according to claim 1, wherein the fastening member head portion includes a metal portion forming the slope portion.

5. A fastening member configured to be applied to a vehicle door fixing apparatus including a door lock striker configured to be provided at one of a vehicle body panel and a door panel, a door lock assembly configured to be provided at the other one of the vehicle body panel and the door panel, a latch mechanism provided at the door lock assembly, wherein a vehicle door is fixed in a closed state in a case where the door lock striker engages with the latch mechanism in response to a closing operation of the vehicle door, the fastening member comprising:

a fastening member head portion configured to protrude from a panel surface of the other one of the vehicle body panel and the door panel, the fastening member fastening the door lock assembly, the fastening member head portion including a contact portion which comes in contact with an inclined surface of a wedge member configured to be arranged at a panel surface of said one of the vehicle body panel and the door panel in response to the closing operation of the vehicle door, the door lock striker configured to be provided at said one of the vehicle body panel and the door panel, wherein the contact portion corresponds to a slope portion, the slope portion being formed over an entire circumference of the fastening member head portion.

6. The fastening member according to claim 5, wherein the fastening member includes a fastening body including a fastening body head portion, the fastening member includes an annular body including a tapered surface forming the slope portion, and the annular body is fixed to the fastening body head portion of the fastening body.

7. The fastening member according to claim 5, wherein the door lock striker engages with and disengages from the latch mechanism of the door lock assembly via a striker in/out hole configured to open at the panel surface of the other one of the vehicle body panel and the door panel, and the fastening member head portion is arranged at a plurality of positions with the striker in/out hole interposed therebetween, in a state where the fastening member is applied to the vehicle door fixing apparatus.

8. The fastening member according to claim 5, wherein the fastening member head portion includes a metal portion forming the slope portion.

* * * * *